US005305574A

United States Patent [19]

Fedock et al.

[11] Patent Number: 5,305,574

[45] Date of Patent: Apr. 26, 1994

[54] METHOD FOR ERECTION OF ABSORBER TOWERS USING JACKING SYSTEM

[75] Inventors: Dennis S. Fedock, Marshallville; Gregory B. Glidden, Copley, both of Ohio; Allyn E. Haase, Greensburg, Pa.; Leon V. Urbain, Petersburg, Ill.

[73] Assignee: The Babcock & Wilcox Company, New Orleans, La.

[21] Appl. No.: 784,860

[22] Filed: Oct. 30, 1991

[51] Int. Cl.[5] ..... E04B 1/00

[52] U.S. Cl. ..... 52/741.1; 52/745.04

[58] Field of Search ..... 52/741, 745

[56] References Cited

PUBLICATIONS

Burkel, Raymon J. and Goshorn, Richard F., "Modularization Construction for Flue Gas Desulfurization Retrofit Projects", presented at the Second International Conference on Fossil Plant Construction, Washington, D.C., Sep. 19, 1991.

Scanada, International, Inc., promotional brochures and photographs, publication date unknown, admitted prior art.

Proposal submitted to Public Service of Indiana Jan. 18, 1991.

Two Promotional Brochures of The Babcock & Wilcox Co. admitted prior art.

Transportation Convention Issue, stamped Oct. 10, 1990.

*Welding Design & Fabrication,* "Standpipe Welds Use Filler Septet", pp. 38 and 41, Feb., 1991.

*Primary Examiner*—Carl D. Friedman

*Assistant Examiner*—Lan C. Mai

*Attorney, Agent, or Firm*—Daniel S. Kalka; Robert J. Edwards; Vytas R. Matas

[57] ABSTRACT

A method for erecting absorber towers using trestle means (26) with jack means (32) to assemble a course and then lift it while constructing the next course below it. The first course is lowered on the just assembled course and welded thereto. These steps are repeated to form the outer wall (34) of the absorber tower (10). A clearance (48) is provided between the elevated course and the course to be assembled for installing the internal components of the tower. Advantageously, the method of the present invention allows for the construction of an absorber tower on site in retrofit applications where space may be restricted and access limited.

17 Claims, 10 Drawing Sheets

METHOD FOR ERECTION OF ABSORBER TOWERS USING JACKING SYSTEM

BACKGROUND OF THE INVENTION

1. Field of the Invention

The present invention relates in general to a method for constructing absorber towers, and in particular, to a method for erecting an absorber tower for flue gas desulfurization (FGD) using a jacking system.

2. Description of the Related Art

Absorber towers are devices known in the art, and are employed in conjunction with furnaces or boilers, as part of their flue gas desulfurization (FGD) system. The purpose of the flue gas desulfurization system is to treat the flue gas emissions produced by the combustion process taking place in the boiler.

When planning the installation of a new boiler or furnace such as for a modern utility power plant, absorber towers are often included in the overall scope of work for the project. However, many of the existing boilers in use today were not originally equipped with absorber towers, and in fact are operating with no means provided for flue gas desulfurization.

The recent enactment of the Clean Air Act requires utilities and industry to limit their operations' flue gas emissions, so as to be at or below specified compliance limits. As such, viable options for minimizing said emissions are being sought and implemented. The installation of flue gas desulfurization systems, with their respective absorber towers, is one means of ensuring compliance with the Act.

In the case of an existing plate site, the installation of absorber towers must be performed on a retrofit basis. Space available for (1) material receipt, storage, laydown, and staging; (2) ground assembly of FGD system components; and (3) construction accessibility, is typically limited on these types of installations. This space limitation presents a problem to the FGD system owner and erecting contractor(s) with regard to work scheduling, logistics, and overall productivity.

To date, several scenarios of absorber tower shipping configuration/erection method have been realized. One scenario has been to maximize absorber tower shop fabrication and assembly, and ship a minimal number of "modules" per absorber tower to the jobsite. A typical "module" has consisted of a circumferential shell complete between established horizontal field weld lines, with external stiffeners, internal supports, and respective absorber internals installed. Upon receipt on the jobsite, modules have been "stacked" on top of each other, horizontal field welds completed at the splice lines, and upon completion of field testing, the absorber tower was ready for operation. This scenario is an effective approach contingent on the existence of the following conditions:

1. A jobsite accessible via a navigable waterway;
2. An absorber tower fabricator with facilities, material handling, and barge loading capabilities on a navigable waterway;
3. Barge landing and off loading facilities available on the jobsite;
4. Jobsite accessibility for transport of the modules from the barge landing and off loading area to the point of final absorber tower installation;

5. Available space on the jobsite for the placement and utilization of heavy lift cranes for the erection of absorber tower modules in their final position.

Although this approach has proven to be effective on certain projects in the past, the jobsite enhanced by each of the above conditions in rare.

In the absence of a navigable waterway, or when the jobsite is not conducive to the receipt of shop assembled modules, absorber tower material has been shipped to the jobsite in a "knocked down" configuration. Shell plates have been provided in sizes commercially available from the mills, typically 8'×20', shop rolled to the curvature of the respective absorber tower shell, and delivered to the jobsite in specially designed cradles, either via trunk or rail load. External stiffeners, internal support members, and absorber internals have been shipped as loose pieces for field installation. Upon receipt of the loose material on the jobsite, two basic methods have been used for the erection of the absorber tower. Given the availability of space for ground assembly "tables" in close proximity to the final location of the absorber tower, loose shell plates have been fit and welded as required to form continuous shell course "rings". Depending on available crane capacity and the accessibility from the ground assembly table to the final location of the absorber tower, shell course "rings" may have been further ground assembled and welded two or three high on the table. Loose stiffeners, internal supports, and absorber internals may have been installed on the ground assembly table as well. Upon completion of the ground assembly activity, the effort for final erection of the absorber tower in place became similar to that required for the erection of shop assembled modules. Heavy lift cranes have been used to "stack" the ground assembled shell courses on top of each other, so as to allow for completion of the horizontal weld between them.

If space has not been available on the jobsite for a ground assembly area, absorber tower components received "knocked down" have been erected, fit, and welded piece by piece in place. The absorber tower was scaffolded as required to access the work, and crawler cranes or derricks were provided for handling the loose material from the ground to final position in the absorber tower. Further, until such time as the tower is inherently structurally stable, temporary bracing, supports, and shoring have been provided as required to withstand the effects of wind and construction dead loads encountered during the erection process.

Associated with each of these absorber tower shipping configuration/erection method scenarios has been a unique set of costs, benefits, advantages, disadvantages, and required conditions for their implementation. In the case of shop assembled modules, benefit has been derived in minimizing the amount of field labor and time required for the erection of an absorber tower. This savings in field labor and time has been offset by the increased costs of transporting and handling heavy modules from the shop to the towers' final location on the jobsite. On the other hand, shop, transportation, and lifting equipment costs have been minimized with the provision of "knocked down" material; but costs associated with increased field labor, schedule time, scaffolding, and the achievement of a quality product have tended to make this option unattractive to the absorber tower erecting contractor. Nevertheless, the option finally selected for a particular project is governed by a unique set of site specific conditions.

Retrofit installations typically present the worst possible conditions to be faced by the absorber tower erecting contractor. In most cases, they are not accessible via navigable waterway; jobsite access and space availability is minimal; and the project construction time span is accelerated to beat a scheduled FGD compliance date. Hence, there is a need for a method of erecting absorber towers in retrofit applications with minimal access and available space. The method should preclude the need for heavy construction equipment, and should minimize the amount of scaffolding required to access the work. The method should be adaptable to any jobsite, regardless of its location and specific site conditions.

SUMMARY OF THE INVENTION

The present invention solves the aforementioned problems with the prior art as well as others by providing a method for erecting an absorber tower using a jacking system, capable of fabricating an absorber tower in retrofit applications on sites having minimum access and available space. The method of the present invention does not require access to water shipping routes, heavy fabrication equipment employed with modules, or scaffolding for work at elevated heights. The method of the present invention is not time consuming or labor intensive.

The method of the present invention erects an absorber tower at or near ground level by arranging a plurality of trestle means with jack means in a selected pattern on a floor plate for the absorber tower. Each course which is preferably a circular ring is assembled by fastening a plurality of shell plates together and then raising the completed course with the trestle means and jack means to a predetermined height. Another course is then assembled below the first course. After the second course is assembled, the first course is lowered thereon and then fastened thereto. The jack means are then reset to raise both of the completed courses as a unit with the steps of assembly being repeated sequentially at or near ground level to construct the entire absorber tower in place right on its final location.

Advantageously, the present method provides a set clearance between predetermined courses prior to fastening them together to allow access for the internal components and fitting and installation necessary in a scrubber system. Finally, the absorber tower is finished by attaching the completed shell courses to the floor plate.

Another feature of the present invention includes a temporary truss for a varying diameter shell of the absorber tower without repositioning the jacks or requiring additional ones.

One object of the present invention is directed to a method for erecting an absorber tower on site at a power plant.

Another object of the present invention is to provide a method for erecting an absorber tower without requiring heavy construction equipment necessary to lift modules.

A further object of the present invention is to provide a method that is not time consuming, does not require double handling of material, is not labor intensive, and is safer than most other available options.

These and various other objects which characterize the present invention are pointed out with particularity in the claims annexed to and forming a part of this disclosure. For a better understanding of the invention, and the operating advantages attained by its uses, reference is made to the accompanying drawings and descriptive matter in which a preferred embodiment of the invention is illustrated.

DESCRIPTION OF THE PREFERRED EMBODIMENT

Figure 1:
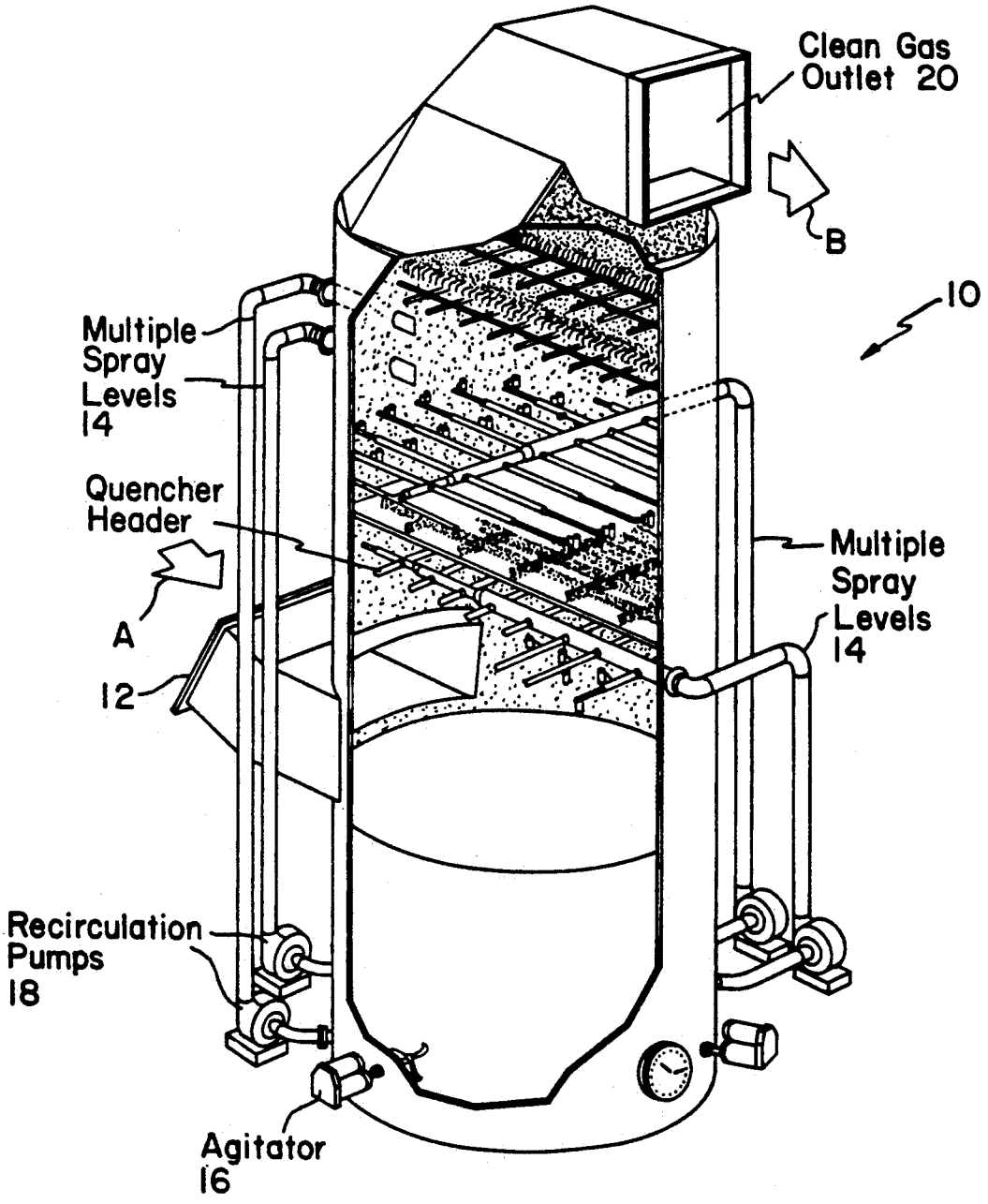
FIG. 1 is an elevational view (with a portion removed) of one type of absorber tower which may be erected with the present invention.

Referring to the drawings, in which like reference characters designate like or corresponding parts throughout the several views, and in particular to FIG. 1, there is shown an absorber tower illustrative of the type which may be constructed in accordance with the present invention. As is known in this art, the absorber tower generally designated (10) receives flue gas from a furnace or a boiler (not shown) as represented by the black arrow A entering inlet flue (12) with the clean flue gas exiting outlet hood (20) as represented by the white arrow B. Inside the absorber tower (10), there are internal components such as multiple spray levels (14), agitation means (16), moisture separators, perforated trays, etc. Outside the tower (10) there are pipes with pump means (18) to recirculate the scrubbing slurry to the multiple spray levels (14). The manner in which absorber towers function is readily known to those skilled in this art. These structures can be very large with diameters ranging from forty feet or more to heights of one hundred fifty feet or more. An absorber tower (10) can weigh as much as four hundred and eighty tons or more.

Figure 2:
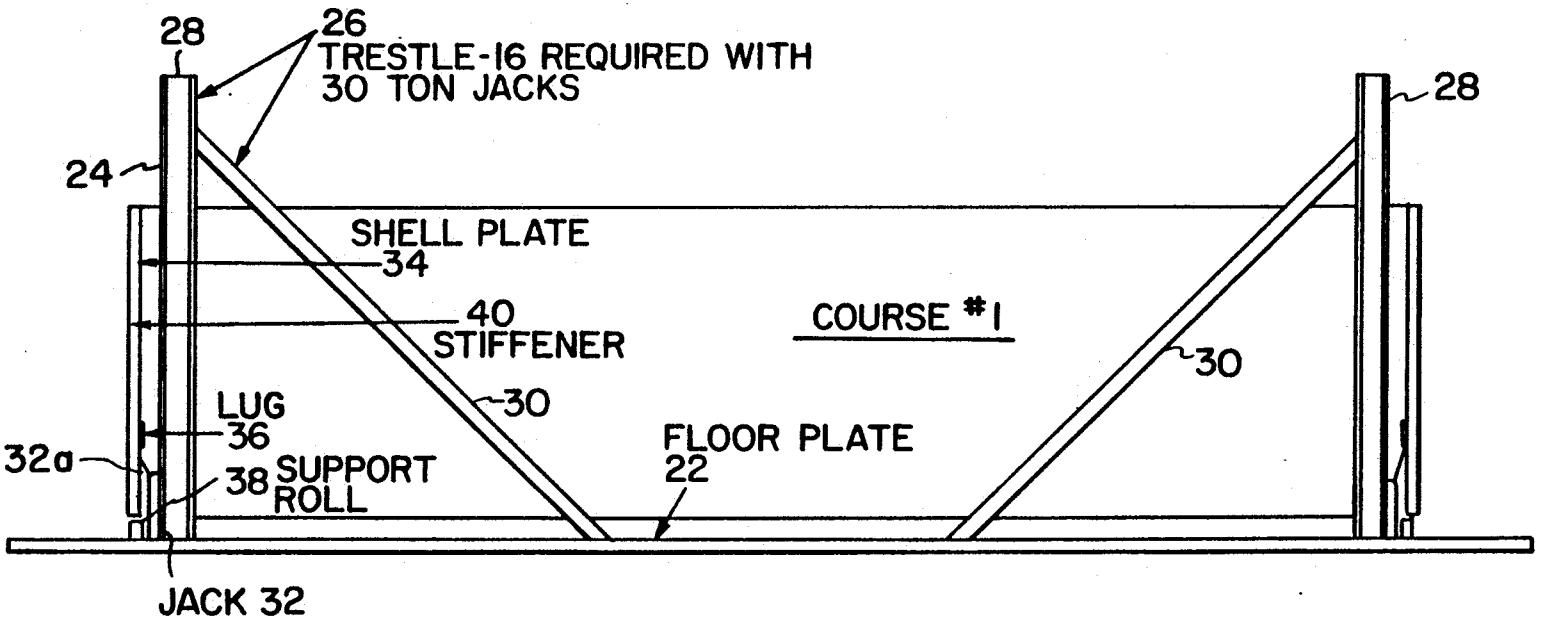
FIG. 2 is a sectional view depicting the trestle means and jack means employed in the present invention for erecting the absorber tower of FIG. 1.
Figure 8:
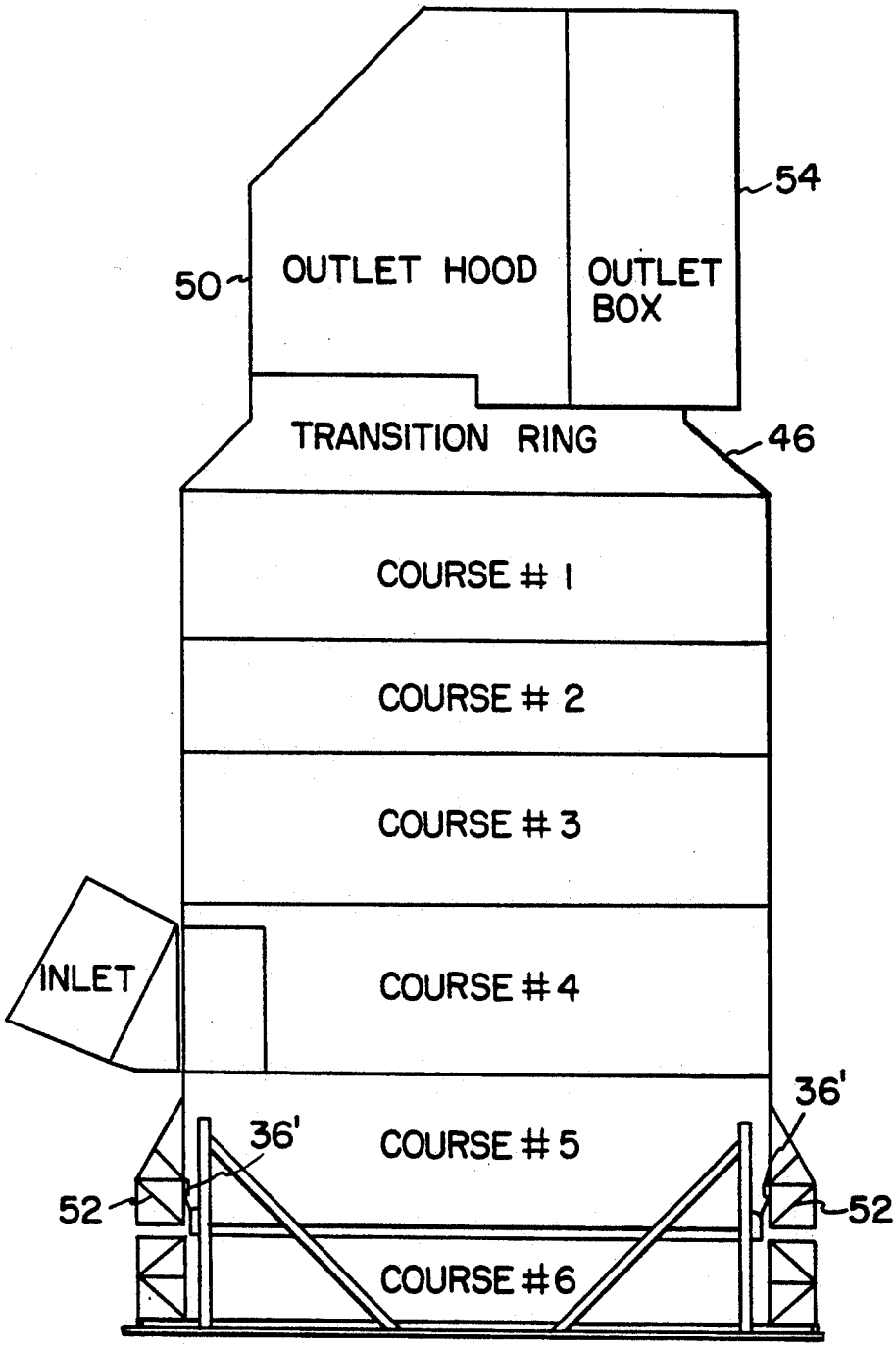
Figure 9:
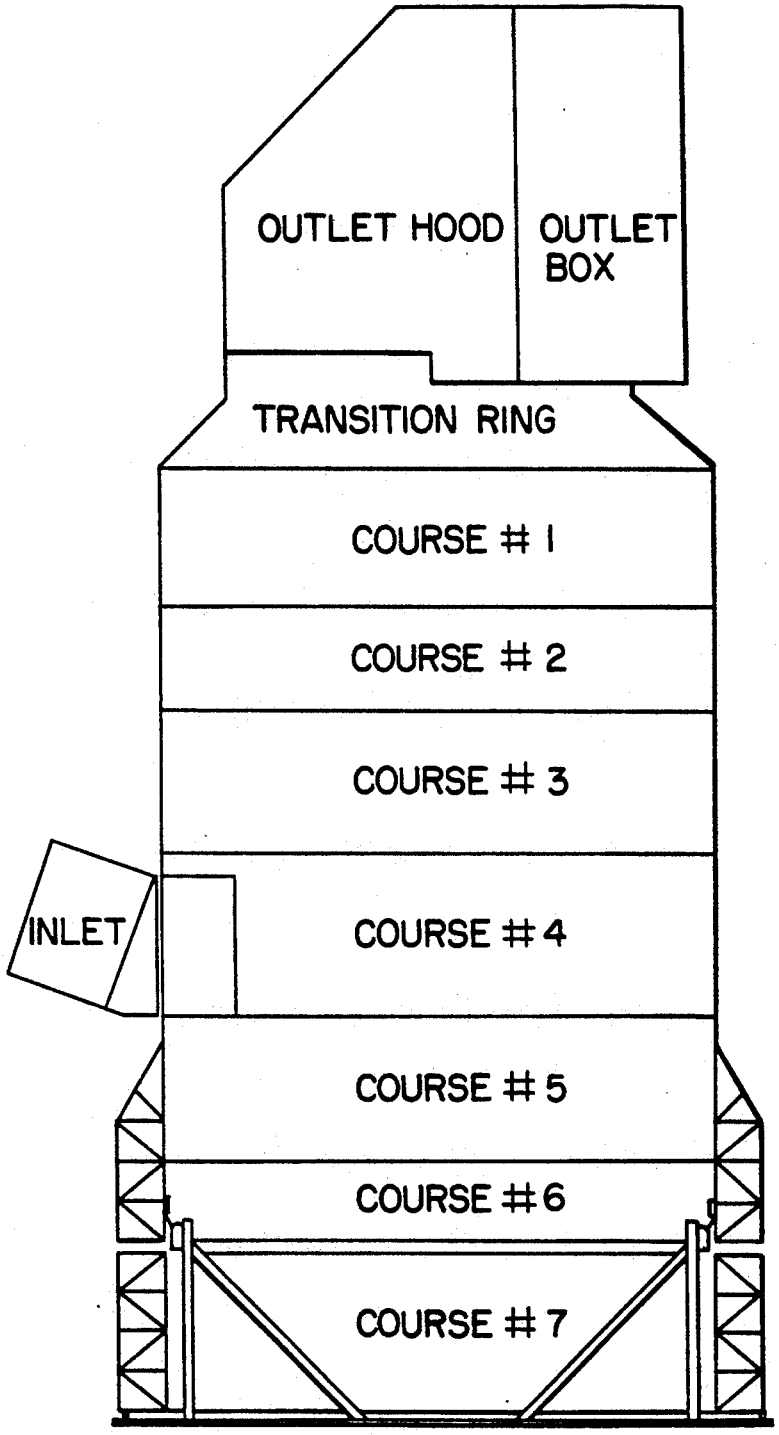
Figure 10:
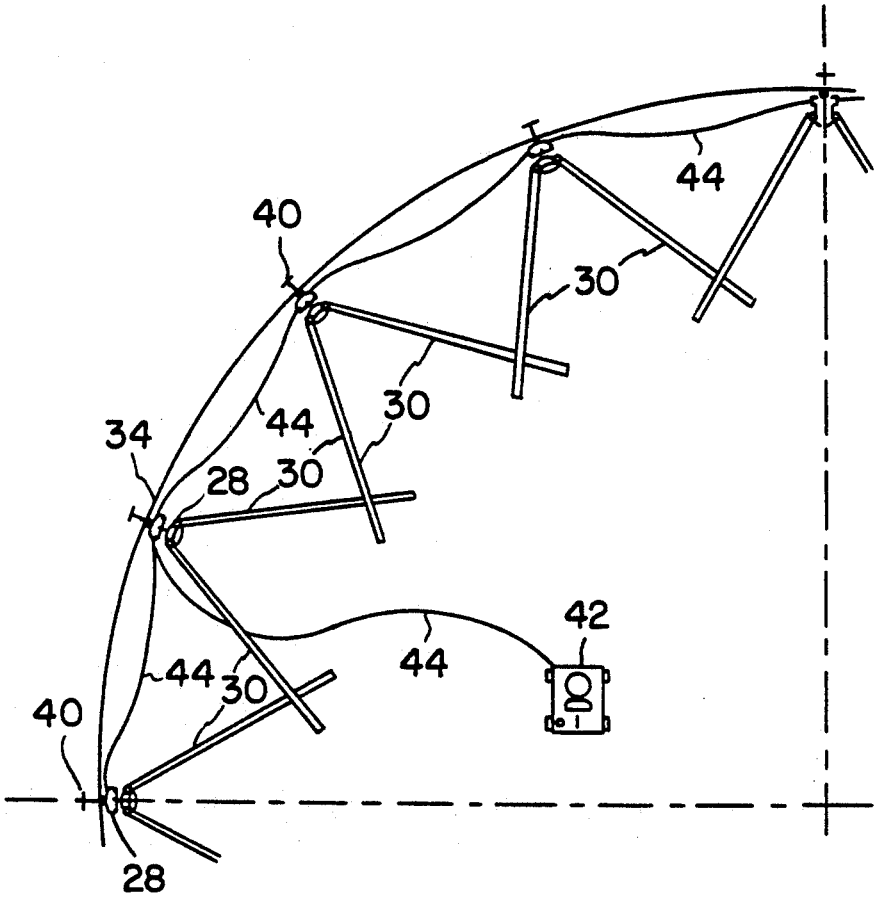
FIG. 10 is a top plan view of a portion of the trestle means and the jack means positioned in the absorber tower during construction.

Next, referring to FIGS. 2–9, there are illustrated sectional views of the steps employed in the present invention to erect such a tower. In FIG. 2, a floor plate (22) for the absorber tower (10) is constructed by laying out a plurality of plates and fastening them together such as by welding in the shape of the absorber tower which is normally circular for a cylindrical tower. Trestle means (26) are equally spaced around what will be the circumference of the absorber tower shell or outer wall (34). The trestle means (26) includes a column (28) supported from the absorber floor plate and foundation and braced back angularly by two backstays (30) to the absorber tower floor plate (22) as seen in FIGS. 2 and 10. Preferably, the backstays (30) are positioned angularly overlapping each other stabilizing the column (28) as shown in FIG. 10. Jack means (32) are adapted to climb a track (24) such as a square steel jack rod mounted on the face of the flange of the column (28). Suitable trestle means (26) and jack means (32) as well as the related hydraulic equipment are available from Scanada International Inc.

Internal scaffolding (not shown) is provided during set up so that work can be comfortably performed at or near the ground level up to about 15 feet high. Also, welding stations are set-up so that the welding is all done at this level without moving equipment up or down the tower. Portions of the tower such as the floor plate may be covered with protective, fire retardant plywood for facilitating construction operations.

Course #1 which forms part of the wall (34) of the absorber tower is assembled from shell plates fastened together preferably by welding. The shape of the first course #1, as well as the other subsequent courses described in this embodiment is a circular ring formed by the shell plates to make up selected portions of the outer wall or shell plates (34) of the absorber tower (10). Of course, it is understood that method of the present invention is equally applicable to other shapes for an absorber tower and not just cylindrical towers. Each course is provided with lugs (36) temporarily fastened to the inside wall of the course which the lifting arm (32*a*) of the jack means (32) lifts against when jacking the course. Support rollers (38) are employed as a platform on which to place the shell plates when assembling them to form the outer wall (34). The support rollers (38) also serve as a means for rotating a portion of the outer wall (34) as it is formed. Alternately, support stands may be used without rollers.

External wall stiffeners (40) are fastened to the outer wall (34) in predetermined locations and in order to accommodate any bending moments induced in the absorber tower wall by the jacking operation, the jack means (32) and trestle means (26) are located coincident with the center line of the external wall stiffeners (40) as best seen in FIG. 10.

After course #1 is assembled the transition ring (46), outlet hood (50), and outlet box (54) may be erected and fitted on top of course #1, then the jack means (32) lifts course #1 with the foregoing attachments by way of the lugs (36). It should be realized that the outlet transition ring (46), outlet hood (50), and outlet box (54) may be installed at this time or later depending on the particular situation.

Figure 3:
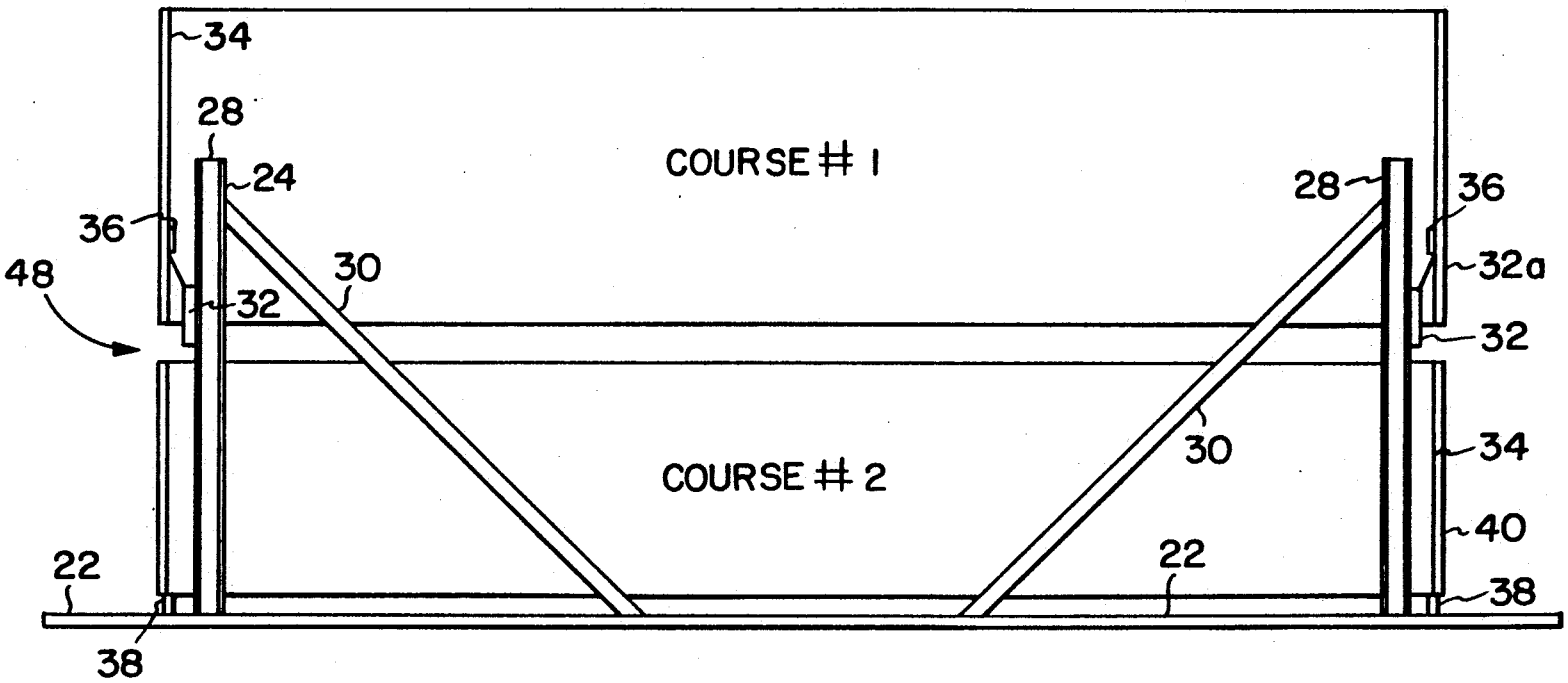
FIG. 3 is a view similar to FIG. 2 illustrating another step in the method of the present invention.
Figure 4:
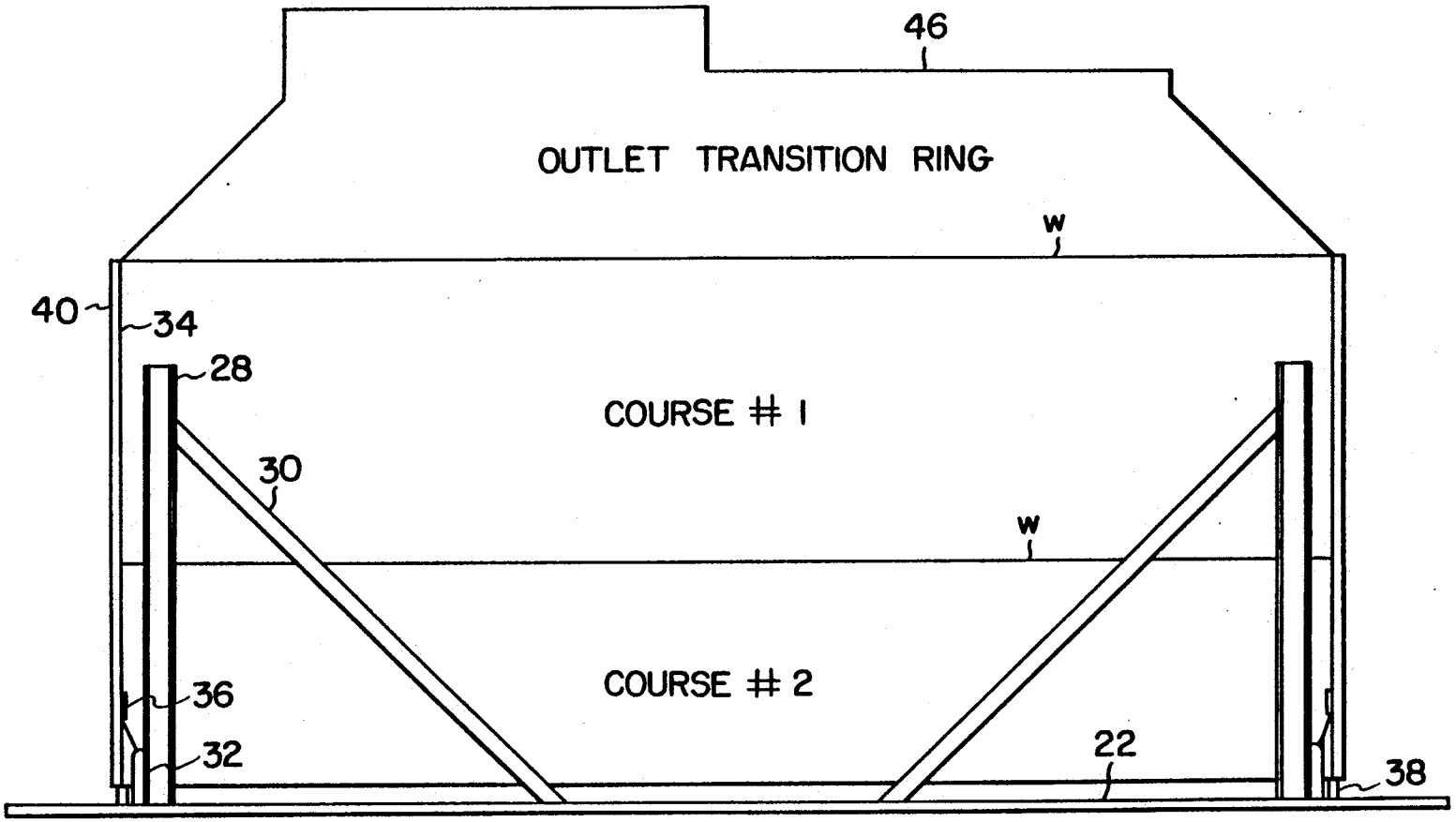
FIGS. 4–9 are views to similar FIGS. 2 and 3 illustrating sequentially the steps of the method of the present invention erecting an absorber tower, with FIG. 9 depicting the absorber tower near completion.

The jack means (32) climbs along the track (24) on the column (28) through the action of hydraulically actuatable wedges so that course #1 is raised to a sufficient height such as about fifteen feet and course #2 assembled therebelow as shown in FIG. 3. Since absorber towers may weigh as much as 480 tons, the present invention in the preferred embodiment employs sixteen trestle means (26) with sixteen thirty ton jack means (32) equally spaced around the circumference of the absorber tower. A single hydraulic pump controller (42) controls all of the jack means (32) with a common hydraulic control line (44) as shown in FIG. 10. This allows an assembled course to be simultaneously lifted around its perimeter to the selected height. Referring back to FIG. 3, course #2 is assembled as previously described with respect to course #1. After course #2 is assembled, course #1 is lowered and a horizontal weld "w" is made to fasten course #1 to course #2 as shown in FIG. 4. This process is repeated sequentially for the other courses with the completed portion being raised together as a unit.

Figure 5:
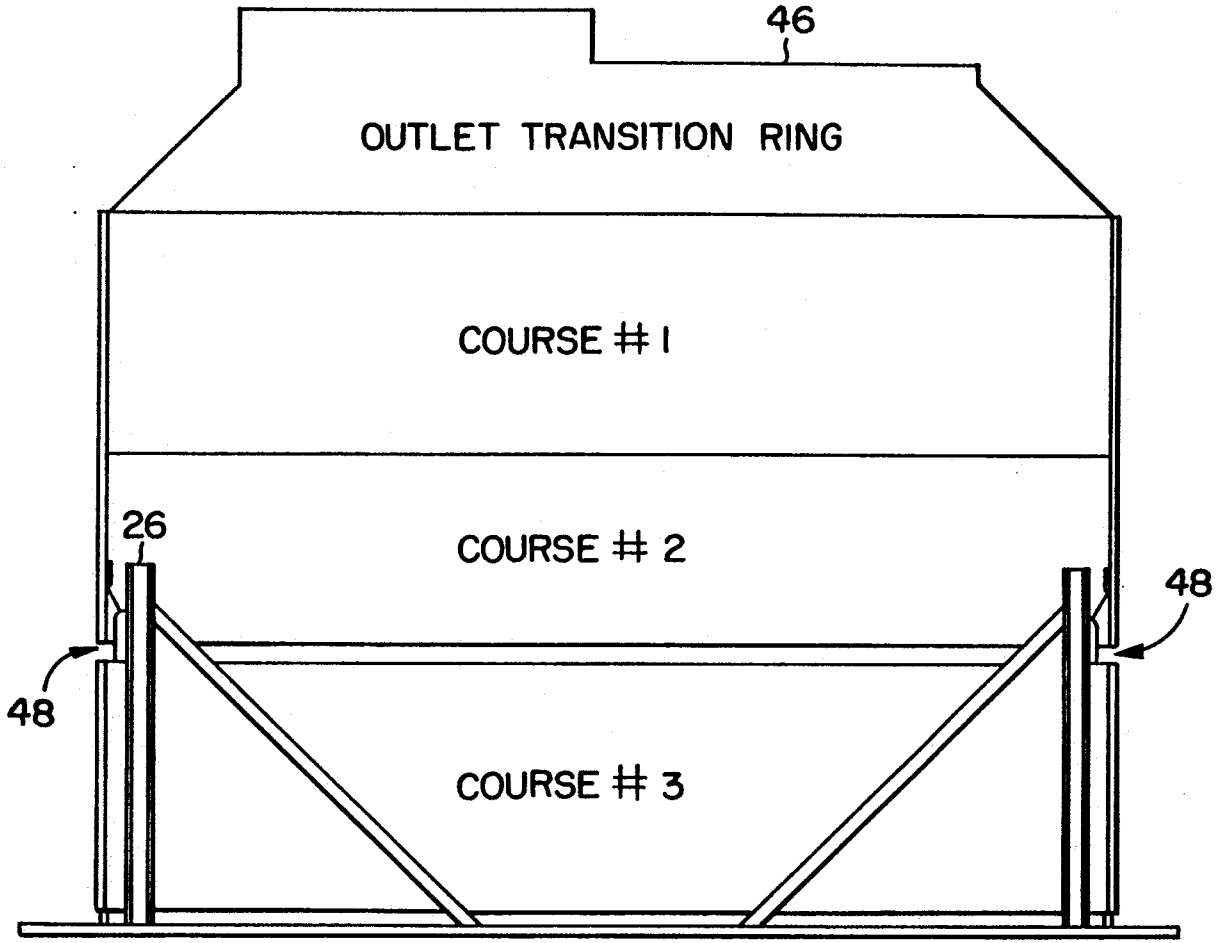

FIG. 5 shows a completed portion of the absorber tower raised with course #3 being assembled therebelow. The height of the trestle means (26) provides a vertical clearance (48), preferably of about four feet, between the elevated portion and the course being assembled. The clearance (48) allows access for installing the internal components in the absorber tower. In this manner, the internal components can be fit and welded in place as soon as the course is completed and wherever the internal components are desired. The important feature of the method of the present invention is that these internal components can be installed at or near ground level with the completed portion of the absorber tower being elevated for assembling another portion thereof directly below.

For illustrative purposes the upper mist eliminator underspray headers and manifolds are installed in course #1 along with lower mist eliminator overspray headers and manifolds. Course #2 contains the lower mist eliminator underspray headers and manifolds, and the upper absorber spray headers and manifolds. The middle and lower absorber spray headers and manifolds are installed in course #3. Absorber trays and quench spray headers and manifolds are situated in course #4. Temporary supports can be utilized to facilitate installation of the internal components. The lifting lugs and any temporary supports are removed when the jacks are reset for lifting the completed portion, or after they have served their purpose. External shell stiffeners (40) are spliced together for the courses during the fastening step.

Figure 6:
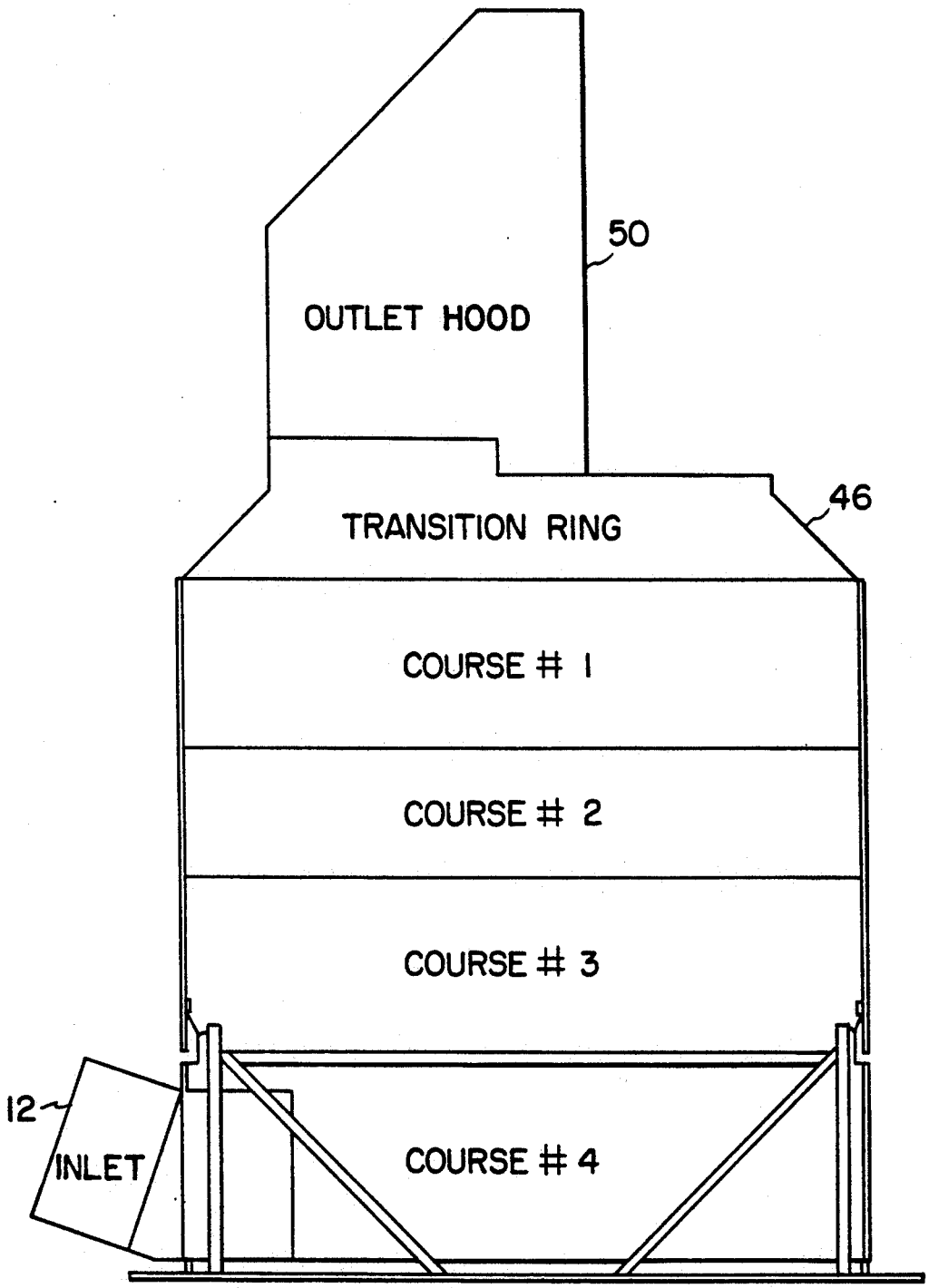

FIG. 6 shows that as course #4 is assembled, the inlet flue (12) is constructed therein at that time. Any other external components may be installed in a similar fashion with a predetermined course.

Figure 7:
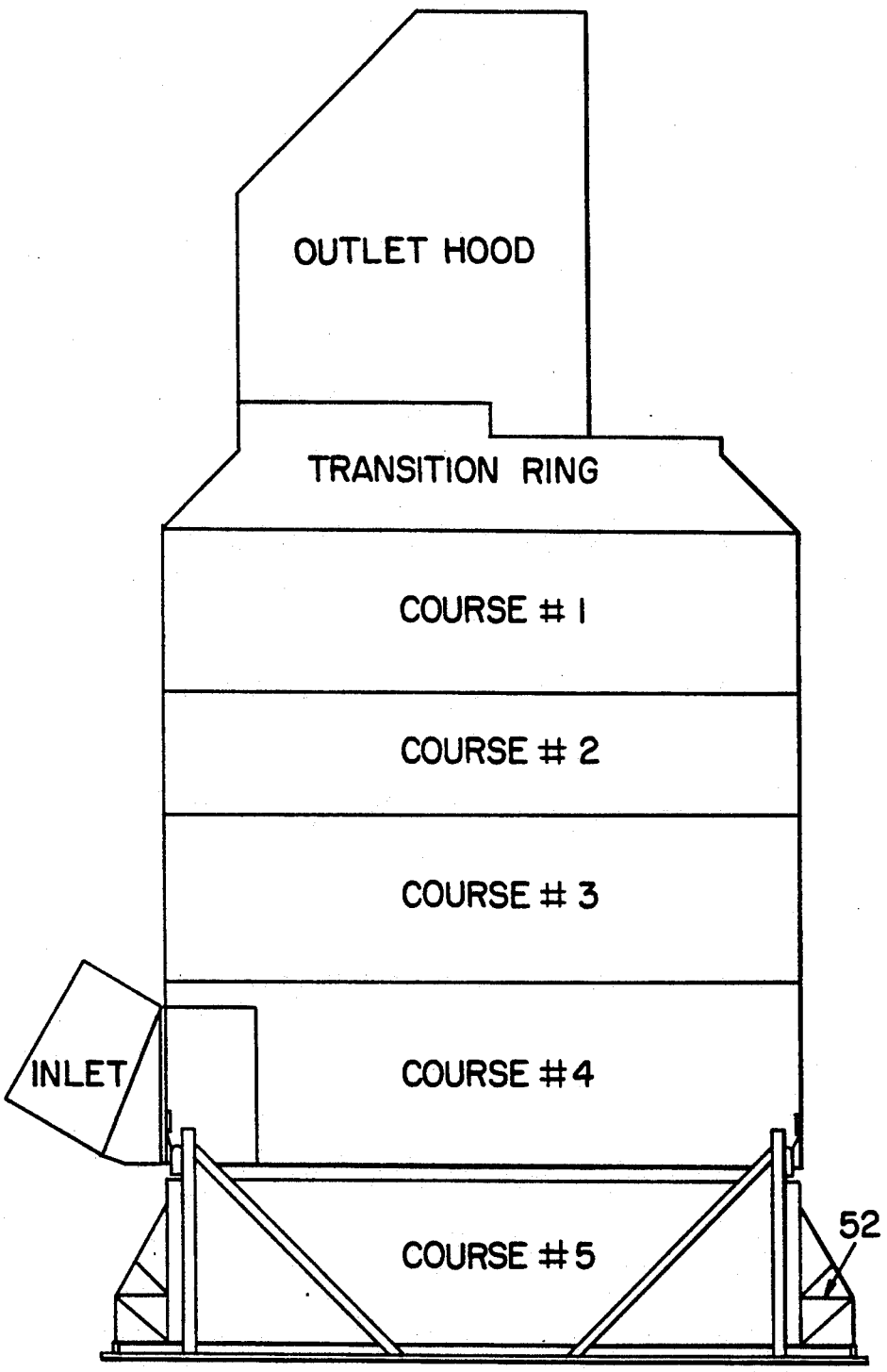

While the process described with respect to FIGS. 1–6 may be repeated for an absorber tower having a continuous circumferential diameter, there exist absorber towers with varying circumferential diameter walls as shown in FIG. 7. In order to implement the method of the present invention with the existing equipment, a temporary truss (52) is built with members fastened together by welding or the like to provide a lifting support for lugs (36') with which the jack means (32) can lift the assembled portion of the absorber tower. Course #4 is lowered and fastened to course #5. The jack means (32) are reset and course #5 is lifted with the lugs (36') on truss (52). The foregoing steps are then repeated as shown in FIGS. 8 and 9 with the addition of truss (52) to any courses having a greater diameter. Truss (52) can be constructed to whatever course diameter required. While FIGS. 6–9 show the outlet hood (50) and outlet box (54) in place, it is to be understood that these portions are preferably added in the beginning steps so that heavy equipment is not required to lift them in place later. However, as FIGS. 6–9 show, these additions can be made later if the work site allows it.

Referring to FIG. 9, after course #7 is assembled and welded to course #6, the structure is lowered and welded to the floor plate (22) with the temporary truss (52) and any other temporary structures being removed from inside. As described by the foregoing, the absorber tower (10) is erected in place directly on the site without the need for heavy construction equipment. As mentioned earlier, the present invention advantageously provides a welding station near ground level without the requirement for scaffolding or movement of the equipment from one location to another.

While a specific embodiment of the present invention has been shown and described in detail to illustrate the application and principles of the present invention, it will be understood that it is not intended that the present invention be limited thereto, and that the invention may be embodied otherwise without departing from such principles. For example, while the method utilizes equipment inside the absorber tower, it is also understood that suitable trestle means and jack means may be utilized at equally spaced locations on the outside of the wall of the absorber tower so that the jacking and fabrication occurs on the outside.

We claim:

1. A method for erecting an absorber tower, comprising the steps of:

positioning a plurality of trestle means with jack means in a selected arrangement on a floor plate for the absorber tower;

assembling sequentially a plurality of courses from individual shell plates to form an outer wall of the absorber tower, each course being assembled and then elevated after assembly with the jack means engageably moving up the trestle means;

providing a clearance between the elevated course and the next course being assembled to allow access for internal components;

constructing temporary supports inside the absorber tower for facilitating installation of internal components;

installing spray headers and manifolds as internal components through the provided clearance between the elevated course and next course near ground level in predetermined courses of the absorber tower;

fastening adjacent courses together sequentially by joining an elevated course with a just assembled course; and completing the absorber tower with its internal components contained therein by attaching the final course to a floor plate.

2. A method as recited in claim 1, wherein the positioning step includes situating support rollers near the plurality of trestle means for providing a movable platform for assembling the courses.

3. A method as recited in claim 1, wherein the assembling step includes fastening a plurality of lifting lugs on the shell plates of the course at each of the trestles for a support to lift with the jack means.

4. A method as recited in claim 1, further comprising the step of attaching stiffeners on the outer wall of the assembled course of the absorber tower at predetermined locations to accommodate any bending moments during elevation.

5. A method as recited in claim 4, further comprising the step of splicing stiffeners from one course with another.

6. A method as recited in claim 1, further comprising the step of lowering the elevated course onto the just assembled course prior to the fastening step.

7. A method as recited in claim 1, further comprising the step of constructing a temporary truss proximate to each trestle means to provide a support for elevating a course with a greater diameter.

8. A method as recited in claim 1, wherein the positioning step includes constructing each of the plurality of trestle means with a vertical column supported and braced back angularly by two backstays.

9. A method as recited in claim 8, wherein the constructing step includes mounting a track on the vertical column to which the jack means engageably moves.

10. A method as recited in claim 9, wherein the mounting step includes providing actuatable wedges for engaging and disengaging the track on the vertical column.

11. A method as recited in claim 1, wherein the positioning step comprises the step of spacing the plurality of trestle means with jack means equally around a circumference of the floor plate.

12. A method as recited in claim 11, further comprising the step of attaching stiffeners to the assembled course at predetermined locations.

13. A method as recited in claim 12, wherein the stiffeners are attached externally on the course.

14. A method as recited in claim 13, wherein the attaching step comprises the step of placing the external stiffeners to be coincident with the trestle means for accommodating any bending moments.

15. A method as recited in claim 1, wherein the providing clearance step includes making about a four foot vertical clearance.

16. A method as recited in claim 1, wherein the elevated course is raised to about fifteen feet.

17. A method as recited in claim 1, wherein the assembling step of each course includes making each course about ten feet high.

* * * * *